United States Patent [19]

Stemmle

[11] Patent Number: 4,918,490

[45] Date of Patent: Apr. 17, 1990

[54] BATCH MODE DUPLEX PRINTING

[75] Inventor: Denis J. Stemmle, Webster, N.Y.

[73] Assignee: Xerox Corporation, Stamford, Conn.

[21] Appl. No.: 382,139

[22] Filed: Jul. 19, 1989

[51] Int. Cl.[4] ..... G03G 21/00

[52] U.S. Cl. ..... 355/318; 271/291; 271/301; 355/24; 355/308

[58] Field of Search ..... 355/318, 319, 320, 308, 355/24, 23; 271/291, 301

[56] References Cited

U.S. PATENT DOCUMENTS

| | | | |
|---|---|---|---|
| 4,009,254 | 7/1978 | Andrews et al. | 364/900 |
| 4,116,558 | 9/1978 | Adamek et al. | 355/24 |
| 4,348,101 | 9/1982 | Schonfeld et al. | 355/14 |
| 4,453,841 | 6/1984 | Bobick et al. | 400/126 |
| 4,488,801 | 12/1984 | Gibson | 355/3 |
| 4,607,948 | 8/1986 | Naito | 355/24 |
| 4,699,503 | 10/1987 | Hyltoft | 355/14 |
| 4,806,979 | 2/1989 | Tokoro et al. | 355/14 |
| 4,825,245 | 4/1989 | Fukae et al. | 355/3 |
| 4,834,360 | 5/1989 | Acquaviva | 271/301 X |

FOREIGN PATENT DOCUMENTS 295612 12/1988 European Pat. Off. .

*Primary Examiner*—A. T. Grimley
*Assistant Examiner*—Thu Dang

[57] ABSTRACT

A system for printing collated sets of duplex copy sheets from a multipage job set of electronically reorderable page images sent electronically to the printer in ascending serial page order (preferably for a printer having a trayless duplexing buffer loop path for recirculating a small number of copy sheets imaged on one side back to be imaged on their opposite sides), by sequentially electronically dividing the multipage job set into batches as the page images are being received, with consecutive batches containing page images in ascending serial page order, with each batch containing a small number of page images approximately twice the copy sheet length of the trayless duplexing path, and reordering the page images within each batch for collated duplex printing utilizing the duplexing buffer loop, and printing the copy sheets one batch at a time, printing the first sides of one batch of copy sheets with alternate pages of one page image batch and then printing the other sides with the remaining page images of that one batch, prior to printing any page images from any other batch, and consecutively repeating this process for subsequent batches to produce a collated duplex copy set from the multipage job set. If the printer copy sheet output is face down, all the even page images of one batch are printed, then its odd page images, then the even page images of the next batch, etc.

10 Claims, 1 Drawing Sheet

BATCH MODE DUPLEX PRINTING

Figure 1:
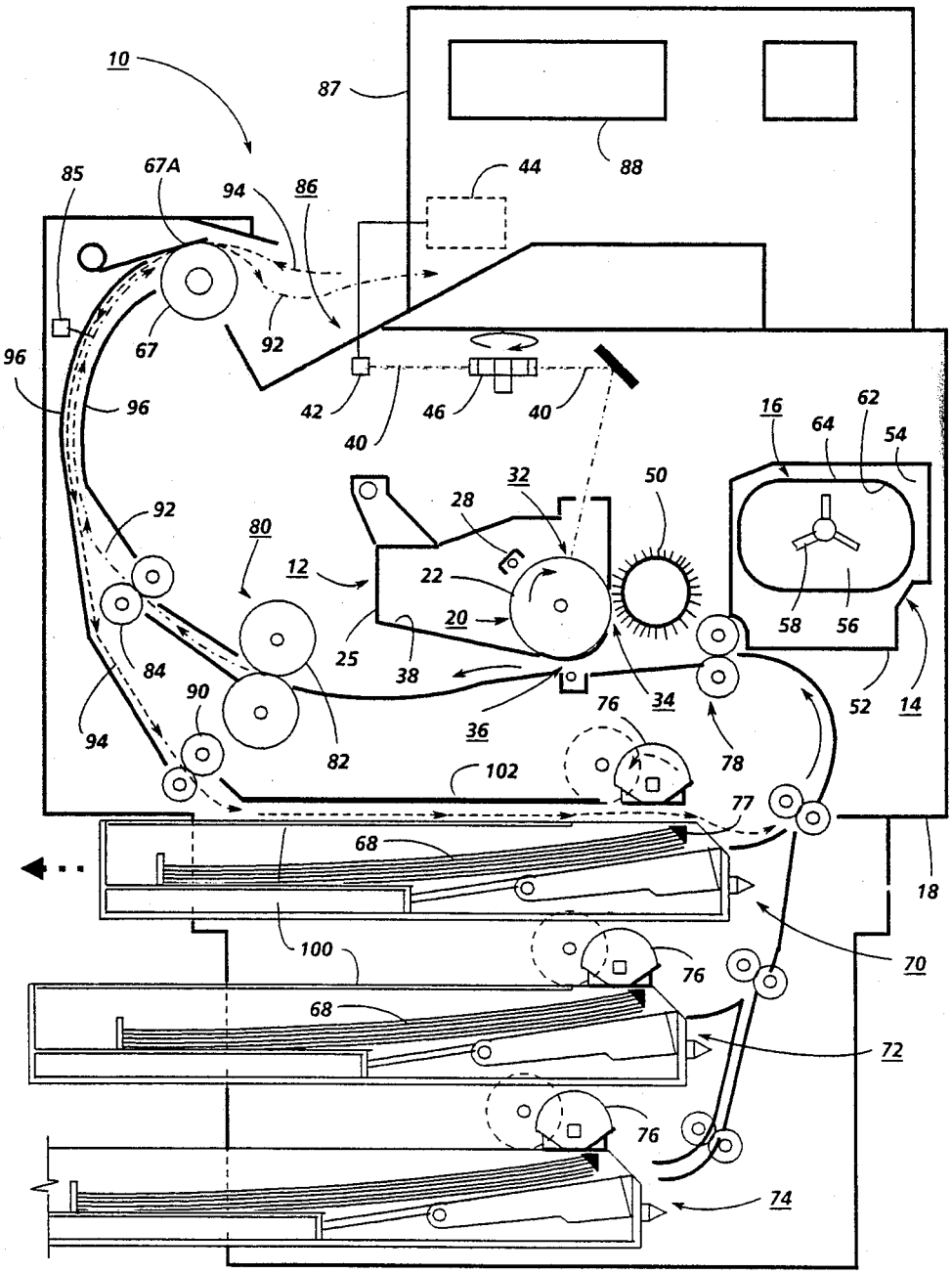

This invention relates generally to printing duplex (printed on both sides) copy sheets from electronic page information, especially suitable for low cost electrostatographic, ink jet, ionographic or other on-demand page printers with a buffer loop duplexing path. More particularly, the disclosed invention relates to a more efficient electronic page presentation order for duplexing mutiplage jobs with reduced skipped printer pitches, for more closely spaced or continuous production of duplex copy sheets, for higher overall productivity, yet with low page buffer memory storage requirements.

The terminology "copiers", and "copies", as well as "printers" and "prints", is used alternatively herein. It will be appreciated that the invention may apply to almost any system in which the images are made electronically, including electronic copiers.

There is disclosed herein a simple, low cost duplexing system for efficiently utilizing a printer with a simple integrated copy sheet output and duplexing return path. It is particularly suitable for a trayless, endless loop, duplexing path.

The disclsed system provides for efficient non-directly-sequential document page copying order or sequencing yet provides collated duplex copy sets therefrom, without requiring a large number of page images to be stored in electronic memory buffers even for jobs with a large number of pages.

It is generally known that electronically inputted printers can desirably provide more flexibility in page sequencing (page copying presentation order) than copiers with physical document sheet input. The printer input is electronically manipulatable electronic page media, rather than physical sheets of paper which are much more difficult to reorder or manipulate into a desired sequence. As also shown in the art noted hereinbelow, it is generally know that certain such reordered or hybrid document page copying orders or sequences may be copied onto a corresponding sequential train of copy sheets in an appropriate copier or printer to provide higher copying machine productivity yet correct page order copy output, especially for duplex copies made with a copier with trayless duplexing, i.e., providing a limited length endless buffer loop duplexing path for the copy sheets being duplexed. The system disclosed herein provides for improvements therein.

The Xerox Corporation "9700" printer, dupex version, for example, has a long duplex paper path, and is suited to print long jobs. It operates in essentially a trayless mode, with a long duplex loop path. Initially, prints (copies) of only the ven sides are made, with one skip cycle between each print until the entire paper path is filled with even side prints alternated with skipped cycles. When the first completed even side (page 2) reaches the transfer area for the second side print (page 1), that page is printed on the back side. The next print to be made, however, is the next even side in the sequence printed on a blank sheet, and interleaved in the blank spaces (previously skipped cycles) left between sheets on the first pass. Thus, the job then proceeds at full productivity, intermixing even sides printed on blank sheets for the first pass with odd sides printed on back of previously completed even sides on their second pass. After the last even side is printed, the system resumes the skip cycle operation until all the odd sides are printed on the last of the even side prints.

For a 30 page job, this "9700" printer duplex version page copying sequence can be represented as shown below. [Each "S" represents a skipped cycle. Previously printed sheet pages making their second pass for their second side copy are shown under the slash and underlined.]

First stage—[evens copied+skips=half productivity]: 2, S, 4, S, 6, S, 8;

Second stage—[odds and evens intermixed—full producitivity]: 1/2, 10, 3/4, 12, 5/6, 14, 7/8, 16, 9/10, 18, 11/12, 21, 13/14, 22, 15/16, 24, 17/18, 26, 19/20, 28, 21/22, 30;

Third stage—[Odds copied+skips=half productivity]: 23/24, S, 25/26, S, 27/28, S, 29/30.

Note that with this "9700" printer sequence, 36 machine cycles are required to make 30 prints. So, for this 30 page job, the overall duplex operation is only 83% efficient. For longer jobs, the effective efficiency improves. But for shorter jobs the overall efficiency degrades, since there will still be 6 skipped pitches—"S".

The sequence used on the Xeror Corporation "5700" printer is somewhat similar, except that it is not a trayless duplex loop system. All the completed first side sheets are stacked into a duplex buffer tray and later re-fed for side two printing. With this system, printer skp cycles are not required during the first stage of the job. The intermixing of side one's and side two's during the second stage of the job is similar to the above sequence for the "9700". The skip cycles are also not required for the third stage since the completed side ones can be fed at full thruput from the duplex tray. Thus, the "5700" duplexing is much more efficient than in the "9700". However, such duplex tray systems are inherently less reliable in some respects. The required duplex tray stacking, reseparating, and refeeding is implicated in the vast majority of duplex paper jams, and complicates job recovery. That is eliminated with the "9700" and other endless moving path duplex buffer loop systems.

Other conventional sequences for printers are also possible. For example, the Hewlett Packard HP "2000" uses a stack and re-feed method of duplex which all even sides of the entire job are printed, followed by printing all of the odd sides. However, for this, the entire job (all the page images) must be stored in memory in order to insure jam recovery.

Significantly, these above Xerox "9700" and "5700" printers and the HP "2000" printers also have a very long wait before the first duplex copy emerges from the printer (first copy out time). That is undesirable for users. They are also very inefficient for small duplex jobs of only a few pages, which is particularly disadvantageous if a large number of copy sets are being made from such a job.

It is desirable to provide duplexing devices using the trayless duplex buffer loop technology, particularly for smaller and less expensive printers. Thus, sequences such as are used for the Xerox 5700" and HP"2000" printers are not appropriate since they require a duplex tray for the copy sheet stacking and re-feeding. The "9700" printer method is also inappropriate because of said inefficiency for short jobs. (Jobs with a small number of document pages and corresponding copy pages per set.) Short jobs predeominate in many user's needs. Irrespective of the job size, the "9700" printer method always requires 6 skipped pitches: 3 for the first series of even sides, and 3 for the last series of odd sides, as discussed.

In general, many other current document handling and duplex copier systems also suffer substantial productivity losses due in part to skipped copier pitches between the imaging of the respective sides of pages of the duplex documents and/or between the copying of the first and second sides of the copy sheets. That is, time wasted waiting for the time required for feeding the documents in an order needed for efficient copying, for feeding documents in the paths to and from the platen, or for turning duplex documents or copy sheets over (inversion), or for feeding sheets being duplexed along paths to and from the transfer station for receiving their first and second side images, and/or for maintaining proper collation of the copy and document sheets.

With the disclosed system, document pages may be presented for copying at the full copying rate of the copier without intervening time delays for maintaining proper collation or for the inversions and returns of the copy sheets being duplex copied, yet collation of the copy sheets is provided at their output. I.e., with this disclosed system, the copier does not normally have to wait (skip one or more copying pitches) for the time required to turn over and return to the transfer station a copy sheet for copying its other side in the desired sequence. With the disclosed duplex copying system, a copy sheet copied from one document page may be recirculating in the copy sheet duplexing buffer loop path for subsequent duplexing while another copy being made of another document page. There is high efficiency precollation copying providing collated copy set output with minimal skipped pitches (skipping of copier copying cycles). Copier productivity loss may be reduced or eliminated. Productivity can therefore more closely approach 100%.

The disclosed system operates by "breaking up" the normal directly sequential order of the multidocument job into small "batch" cyclic copying cycles corresponding in page number size to the duplex buffer loop size.

The document page presentation order is fully coordinated with the path length of the copy sheet duplex buffer loop within the copier for improved efficiency duplex copying. The latter desirably comprises a trayless, endless loop, recirculating copy sheet path, of a type known per se, looping copy sheets to be duplexed from and back to the imaging station. This eliminates intermediate copy sheet stacking or refeeding in a duplex tray between first and second side copying.

Eliminating a conventional intermediate sheet restacking duplexing buffer tray, and its re-separating feeder, eliminates sheet jams and jam clearances associated therewith. It also eliminates this sheet feeder/separator hardware and the space it requires, and associated hardward such as sheet stackers, edge joggers, set separators, bail bars, and tray edge guide resetting means for different sheet sizes.

Of particular prior art interest is Mead Corporation U.S. Pat. No. 4,453,841 issued June 12, 1984 to Bobick, et al, disclosing a trayless duplexing buffer loop path printer system, and noting particularly the page copying sequences shown in FIG. 6, particularly for documents with more than 10 pages, e.g., the examples shown with 16 and 22 pages.

Also of particular interest for also showing page copying sequences or algorithms for a trayless buffer loop duplexing printer is Canon EP 0 295 612 A1 (European patent application) published 21.12.88 by A . Noguchi et al.

U.S. Pat. No. 4,348,101 issued Sept. 7, 1982 to A. Schonfeld, et al (Sperry Corporation), and U.S. Pat. No. 4,825,245 issued Apr. 25, 1989 to K Fukae et al. (Kentek), show a duplex printer with partially similar output and inverting paths to that disclosed herein. Another recent, but less compact, duplexing printer is disclosed in Hitachi U.S. Pat. No. 4,806,979 issued Feb. 21, 1989 to Tokoro et al.

The above-cited Mead Corporation U.S. Pat. No. 4,453,841 to Bobik, et al, is of particular interest for its apparent disclosure of a printer with a batch mode algorithm page order presentation, as particularly shown in FIG. 6 thereof. However, that algorithm appears to operate with the document pages in descending (N to 1) rather than ascending (1 to N) page order, so that printing cannot be started until the entire job is downloaded or buffered, and requiring therefore an electronic storage media of sufficient capacity to hold all the pages of the entire document set or job. If pages are bit-maped, as with mixed graphics, a megabyte or more of memory per page may be required even with data compression and for only 300 spi. Thus, because most computers send information in ascending serial order (starting with page 1), and most printers print in that order, an expensive print server may be required to store and reverse the order to the job before printing. That is disadvantageous for a decentralized environment without a print sever available, or without high baud rate downloading connecting lines from a large central computer. First copy out time can be greatly improved with 1 to N ascending page order since printing can start as soon as the first page is received rather than after the whole job is received, which can be a very long time for a multipage job sent over conventional lines, or even coaxial cable, particularly with bit mapped pages. Ascending or forward (1 to N) page order is also very helpful for duplexing, since a decision as to the last page being even or odd (simplex) does not have to be made until that last page is downloaded, nor does any separate job handling instruction have to be sent in advance for that last odd (simplex) page situation. The printer can handle that situation on its own.

By way of examples of further background on electronic (vs physical) page input and buffering for duplex copying or printing there is noted U.S. Pat. Nos. 4,453,841; 4,099,254; and 4,699,503. Also, Xerox Disclosure Journal publication Vol. 8, No. 1, January/February 1983, p. 7, and its description of the Xerox "9700" duplex version laser printer and its trayless duplexing buffer loop operation. The latter and other electronic document input printers normally provide precollated output, by sequentially making one copy at a time of each document page in repeated copying "circulations" thereof, rather than making plural consecutive identical copies and utilizing sorters (post-collation). As noted in various examples in this art, and discussed further herein, there are different requirements for RDH, or pre-collation, copying vs post-collation or multicopy/sorter, copying. Maintaining collation of the documents and copies without productivity losses is a particular problem, and has been the subject of sequencing and inverting algorithms, as shown in the art.

By way of background, an example of a buffer loop duplexing path copier, with a dual mode inverter/output path feeder system, with reversing rolls, for a choice of simplex or duplex copying, is in Xerox Corporation U.S. Pat. No. 4,660,963 issued Apr. 28, 1987 to the same D. Stemmle, and art cited therein.

Some prior art on copiers with trayless copier subcycle loops for duplexing copy sheets in general includes Xerox Corporation U.S. Pat. No. 4,035,073 issued July 12, 1977 to George DelVecchio (see especially the "Table"); and Kodak 4,264,183 issued Apr. 28, 1981 to M. Stoudt. A trayless copy sheet loop for a duplexing system is also disclosed in U.S. Pat. Nos. 4,453,819 issued June 12, 1984 to K. Wada et al (minolta), or related 4,453,819; and IBM U.S. Pat. No. 4,488,801 to Gibson. Also, Xerox Disclosure Journal Vol. 10, No. 3, pp. 147–8, May/June 1985. IBM EPO Application No. 0 114 966 A1 by D. K. Gibson, published 08.08.84, and based on U.S. Ser. No. 455,368, filed 03.01.83 on "Maximum Throughput Duplexing System for Xerographic Machines is of further background interest for another copier for filling a closed loop duplex path with a sequence of first side copy sheets.

Other patent examples of duplexing copiers, showing duplexing paths including reversible sheet output rollers functioning as sheet inverters, include Xerox Corporation U.S. Pat. No. 4,708,462 to (the same) D. J. Stemmle issued Nov. 24, 1987 and art cited therein, and Canon 4,787,616, and Rich 4,692,020. Said 4,708,462 to D. J. Stemmle discloses an optional path choice of a trayless duplex loop path extending over and bypassing a duplex buffer tray.

Other art of background interest includes U.S. Pat. No. 4,099,254; 4,116,558; 4,607,948; and 4,699,503.

Electronic input of electronic page images in electronic page ordering is discussed herein, rather than a sequence of physical document pages for optical input, as in a conventional copier. Thus a (document) "page" herein refers to the inputted information to be printed on one side of a copy sheet, and its page number refers to the job set position or copying order of that page, irrespective of any actual or physical page nubmers, if any. Each duplex copy shet is thus conventionally regarded herein as having two consecutive page numbers corresponding to the two respective page images printed on its opposite sides.

A Specific feature of the specific embodiment disclosed herein is to provide a printer for printing and outputting collated sets of plural duplex copy sheets from a multipage job set of multiple electronically reorderable page images, wherein said collated outputed duplex copy sheets have one said page image printed on one side of a copy sheet and another said page image printed on the other side of the copy sheet, and wherein said printer includes a duplexing buffer loop providing a plural copy sheet capacity duplexing path for recirculating therein plural copy sheets imaged on one side back to be imaged on their opposite sides to make said duplex copies, the improvement comprising; electronically dividing the multipage job set into plural batches of plural page images per batch with the number of page images per batch corresponding to said copy sheet capacity of said duplexing path within a said batch, reordering said plural page images within said batch for proper collated duplex printing with said duplexing buffer loop, priting copy sheets from one said batch of page images at a time, by printing the first sides of a corresponding batch of copy sheets with alternate pages of said one batch and recirculating said copy sheets in said duplexing path, and then printing the remaining page images of said one batch (the alternate page images not printed on said first sides of said copy sheets) onto the second sides of said batch of copy sheets, prior to printing page images from any other said batch of page images, and consecutively repeating this process for subsequent said batches until a collated copy set is produced from the multipage job set.

Further specific features provided by the system disclosed herein, individually or in combination, include those wherein said consecutive batches consecutively contain page images in ascending serial page order, and said batches are consecutively printed in ascending serial order, wherein said multipage job set comprises the pages of a multi-page document to be copied which are sent electronically to the printer in ascending serial page order, and which are electronically divided into said plural batches sequentially, one batch at a time, as the page images are being received, in the order of receipt, with consecutive said batches respectively containing page images in ascending serial page order, and wherein said batches are consecutively printed in the sequential order in which they are divided, wherein said plural copy sheet capacity duplexing path is a trayless duplexing path with an endless loop plural sheet path length, and wherein said number of page images in each said batch is approximately twice the the number of copy sheets required to fill said copy sheet path length of said trayless duplexing path, wherein said trayless duplexing path has a copy sheet path length of two or three copy sheets, and wherein the multi-page job set is divided into batches of four page images per batch, and wherein the first batch to be printed is printed on the first two copy sheets to be printed with the page image sequence 2, 4, 1, 3; and wherein the second batch to be printed is printed on the next two copy sheets with the page image sequence 6, 8, 5, 7, wherein the trayless duplexing path copy sheet length is three, and wherein the multi-page job set is divided into batches of six page images per batch so that the first batch to be printed is printed on the first three copy sheets to be printed with the page image sequence 2, 4, 6, 1, 3, 5, wherein said copy sheets are outputted to stack face down, and wherein all of the even side page images of one said batch are printed first, followed by printing all of the odd side page images of that batch, before any page images of another batch are printed, and/or wherein, for other than a very small job set, and for all but the last batch of plural page images in certain job sets, for every said batch every other (alternate) page image of that one batch is first printed on the first sides of a corresponding batch of copy sheets in ascending page image order without skipping any copying pitches between copy sheets, and said one batch of copy sheets is recirculated in said duplexing path, and wherein this is followed by the printing of all of the remaining page images of that same batch (the alternate page images not printed on said first sides of said copy sheets) onto the second sides of said first batch of copy sheets, printed in ascending order without skipping any copying pitches between copy sheets, and prior to printing any page images from any other said batch.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus the present invention will be better understood from this description of an embodiment thereof, including the drawing figure (approximately to scale) wherein:

FIG. 1, the FIGURE, is a schematic side view of one example of a duplex printer which may be utilized with the duplex printing system of the invention.

Describing first in further detail this exemplary printer embodiment with reference to the FIGURE, there is shown a duplex laser printer 10 by way of example of an automatic electrostatographic reproducing machine of a type suitable to utilize the duplexing system of the present invention. In the example shown, the printer 10 respectively employs three different replaceable xerographic, developer, and toner cartridge units 12, 14, 16 designed to provide a preset number of images in the form of prints or copies. While the machine 10 is exemplified here as an electrostatographic printer, other types of reproducing machines such as ink jet printers, etc., may be envisioned. Although the present system is particularly well adapted for use in such automatic electrostatographic reproducing machines, it will be evident from the following description that it is equally well suited for use in a wide variety of printing systems and is not limited in application to the particular embodiment shown herein.

Xerographic cartridge 12 includes a photoreceptor drum 20, the outer surface 22 of which is coated with a suitable photoconductive material, and a charge corotron 28 for charging the drum photoconductive surface 22 in preparation for imaging. Drum 20 is suitably journaled for rotation within the cartridge body 24, rotating in the direction indicated by the arrow to bring the photoconductive surface 22 thereof past exposure, developer, and transfer stations 32, 34, 36 of machine 10 when cartridge 12 is in the machine 10. To receive xerographic cartridge 12, a suitable cavity 38 is provided in machine frame 18, the cartridge body 25 and cavity 38 having complementary shapes and dimensions such that on insertion of cartridge 12 into cavity 38, drum 20 is in predetermined operating relation with exposure, developer, and transfer stations 32, 34, 36 respectively. With insertion of cartridge 12, drum 20 is drivingly coupled to the conventional drum driving means (not shown) and the electrical connections to cartridge 12 are made.

In the xerographic process practices, the photoconductive surface 22 of drum 20 is initially uniformly charged by charge corotron 28, following which the charged photoconductive surface 22 is exposed by imaging beam 40 at exposure station 32 to create an electrostatic latent image on the photoconductive surface 22 of drum 20.

Imaging beam 40 is derived from a laser 42 modulated in accordance with image signals from a suitable source 44. Image signal source 44 may comprise any suitable source of image signals such as a memory, document scanner, communication link, tape drive, another computer, etc. The modulated imaging beam 40 output by laser 42 is impinged on the facets of a rotating multifaceted polygon 46 which sweeps the beam across the photoconductive surface 22 of drum 28 at exposure station 32. I.e., a conventional laser printing system is provided.

Following exposure, the electrostatic latent image on the photoconductive surface 22 of drum 20 is developed by a magnetic brush development system contained in developer cartridge 14. The magnetic brush development system includes a suitable magnetic brush roll 50 rotatably journaled in body 52 of cartridge 14, developer being supplied to magnetic brush roll 50 by toner cartridge 16. To receive developer cartridge 14, a suitable cavity 54 is provided in machine frame 18, cartridge body 52 and cavity 54 having complementary shapes and dimensions such that on insertion of cartridge 14 into cavity 54, magnetic brush roll 50 is in predetermined developing relation with the photoconductive surface 22 of drum 20. With insertion of cartridge 14, magnetic brush roll 50 is drivingly coupled to the developer driving means (not shown) in machine 10 and the electrical connections to cartridge are 14 made.

The toner cartridge 16 provides a sump 56 within whih developer comprising a predetermined mixture of carrier and toner for the magnetic brush development system in developer cartridge 14 is provided. Alternatively, single component developer may be provided. A rotatable auger 58 mixes the developer in sump 56 and provides developer to magnetic brush roll 50. Magnetic brush roll 50 is suitably journaled for rotation in the body 52 of cartridge 16.

The developer cartridge 14 body 52 forms a cavity 62 for receipt of toner cartridge 16, cavity 62 of cartridge 14 and body 64 of cartridge 16 having complementary shapes and dimensions such that on insertion of cartridge 16 into cavity 62, cartridge 16 is in predetermined operating relation with the magnetic brush roll 50 in developer cartridge 14. With insertion of toner cartridge 16, auger 62 is drivingly coupled to the developer driving means (not shown) and the electrical connections to cartridge 16 made.

Any residual toner particles remaining on the photoconductive surface 22 of drum 20 after transfer are removed by a conventional cleaning mechanism (not shown) in xerographic cartridge 12.

Prints of the images formed on the photoconductive surface of drum 20 are produced by machine 10 on a suitable support material, such as copy sheets 68 or the like. Supplies of stacked copy sheets 68 may be provided in plural paper trays 70, 72, 74. The copy sheets may be of different sizes. The paper trays 70, 72, 74 here are removable and interchangeable cassette units, known per se. Conventionally mounted in the machine 10, to engage the top of the stack of sheets in each tray 70, 72, and 74 when the tray is inserted into the machine 10, are respective conventional sectored or segmented feed rolls 76 for feeding individual sheets seriatum from the stack of sheets in that tray. This sheet feeding is assisted by conventional stack corner snubbers 77 in the trays. Conventional intermittent drives for the feed rolls 76 are illustrated in phantom therewith. Sheets selectively fed on demand from a tray 70, 72, or 74 are all fed to a common registration pinch roll pair 78 in the machine 10 paper path. Following this conventional sheet registration at stalled pinch roll pair 78, the sheet is forwarded on by those rolls to transfer station 36 in proper timed relation with the developed image on drum 20. There, the developed image is transferred to one side (the upper surface) of the copy sheet 68. Following transfer, the copy sheet 68 bearing this toner image is separated from the photoconductive surface 22 of drum 20 and advanced to fixing station 80 where a roll fuser 82 fixes this transferred powder image thereto. After fusing the toner image to the copy sheet 68, the copy sheet 68 is advanced downstream to print discharge rolls 84, which it turn feed the copy sheet downstream towards print output tray 86. A suitable sheet sensor 85 senses each copy sheet as it passes from fixing station 80 to output tray 86. The final discharge of the copy sheet or print to output tray 86 is by elastomer copy sheet output path rollers 67 nipped with a mating spring loaded baffle plate 67*a*.

The duplex printer 10 has a copy sheet output path 92, shown in a dot-dash line with arrows from fuser 80 through output path roller nip 84 rollers on up through curved baffles or chute 96 through copy sheet output path rollers 67 to eject sheets out into output tray 86. Connecting with and utilizing a substantial portion of this output path 92 is a duplexing path 94, shown here in dashed lines and arrows, for returning copy sheets to be imaged on their opposite sides to make duplex copies. This duplexing path 94 includes a copy sheet inverting system provided by reversal of copy sheet output path or ejecting rollers 67. Rollers 67 alternatively eject copy sheets, or with reversal, transport copy sheets into the duplex path 94.

Preferably the distance between output rollers 84 and the reversible ejecting rollers 67 is approximately one half the sheet dimension, in the sheet feeding direction, of the shortest sheet to be duplexed. Thus, for a conventional 11" long letter size sheet 68 fed short edge first this preferable distance between nips 84 and 67 is approximately 7". Thus, the rollers 84 feed copy sheets therefrom downstream through the copy sheet output path 92 to the reversible rollers 67 until about one half of the sheet extends downstream out of the nip of these output rollers 67, without losing control of the sheet. That is, the chute 96 provides a copy sheet guide path length between said output path roller nip 84 and the reversible copy sheet output path roller 67 which is a substantial portion of the dimension of the copy sheet being fed, but substantially less than that copy sheet dimension, so that a substantial portion of the copy sheet is extendable through and downstream of the output rollers 67 before the copy sheet is released thereby.

The plane of the nip of the reversible rollers 67 with their engaging surface 67*a*, and the curve of the baffles or chute 96, and the position of the rollers 84, are such that a copy sheet reversibly driven by the reversal of rollers 67 is automatically driven into the duplexing path 94. The chute 96 provides an arcuate copy sheet guide path, against the outside of which a reversed sheet fed back by reversed rollers 67 can uninterruptedly pass by the next sheet, which is moving downstream in the same chute 96 towards rollers 67. Thus, a subsequent copy sheet may be fed downstream (upwardly) in the arcuate copy sheet guide path 96 simultaneously with, for for a substantial time period with, the reverse (downward) feeding of the preceding copy sheet backwards into the duplex path 94, even if the inter-copy gap or pitch space is only about 5 cm.

Sheets 68 reverse fed back into the duplexing path 94 are fed from rollers 67 down through arcuate chute 96 into the nip of duplexing path rollers 90 in the duplexing path. These duplexing path rollers 90 are positioned substantially further in sheet path distance from reversible rollers 67 than are output path rollers 84, and are substantially separated from rollers 84, and rollers 84 have only one opposing pair of rollers, unlike a conventional three or four roller inverter. With this separate and further downstream path location of duplexing path rollers 90, only that one additional set of rollers 90 is needed for providing duplex path feeding in this system. However, rollers 90 are spaced from rollers 67 by a sheet path distance slightly less than (within) the feeding dimension of the shortest sheet being duplexed, so as to not to release these sheets and to provide positive nip feeding in at least one nip at all times.

As shown by its rotational arrow in the Figure, the outer rollers 84 rotate towards, but are spaced from, the outer wall or baffle of chute 96, thereby helping urge a reverse-fed sheet 68 (from reversed rollers 67) into the duplexing path 94. The (now) lead edge of a reverse driven sheet which might hit this roller 84 is urged to flip over into the duplex path. The duplexing path 94 at that point diverges from the output path 92 and passes by the outside of the rollers 84. This urging of any reverse moving sheet into the duplexing path 94 is also assisted by the curvature of chute 96 and the beam strength of the sheet, which also urges the sheet towards the outside wall of chute 96. However, the chute 96 need not necessarily be arcuate. The outer wall of chute 96 is diverging away from output path 92 and rollers 84 to form the duplex path 94 at that point. Note that no separate inverter chute is required as in most inverter designs. Here there is only one single inverter chute 96 and it is an integral part of the output path, and also of the duplexing path. The sheet reversing for inverting function is integral the normal exit transport in a single paper path. When output of the sheet is desired, rollers 67 simply continue to rotate in the same forward or downstream feeding direction until the sheet is fully ejected, instead of reversing after only about one half of the sheet is extending therefrom.

The long path distance between the nips of rollers 84 and the nips of reversible rollers 67 allows ample time for the reverse feeding of the proceeding sheet out of the nip of rollers 67 into the duplex path 94 before the lead edge of the next copy sheet in the output path 92 reaches the rollers 67 (at which point the rollers 67 must be reversed again to drive that sheet out into tray 86). Thus an expensive high speed or critical reversal system is not required for the rollers 67. Yet the overall path lengths are such that 2, or even 3, sheets can be continuously circulated in the combined output and duplex path loop without pitch skips or copying rate reductions. For duplexing, clean sheets may be aternatingly intermittently fed from any of trays 70–74 to be copied on their first sides alternately and intermixed with the return of those sheets through the duplex path for their second side imaging and outputting into output tray 86.

The forward or ejecting sheet drive velocity of reversible rollers 67 may be about the same as the reverse or duplexing sheet velocity. However, by increasing or decreasing the reverse drive speed and the rollers 90 speed, the duplex path 94 velocity may be changed relative to the simplex or output path speed 92. That allows for a different pitch in the duplex path, e.g., to give a choice of efficient duplex loops for either two or three sheets. (Two sheets requires less page buffer memory.) A faster duplex path can return sheets faster to the transfer station for a second side image.

The duplex return rollers 90 feed the sheet being duplexed down onto the top of, and over an upper cover surface 100 of, the uppermost cassette tray 70. The rollers 90 feed the sheet along that tray cover surface 100 to the cassette feeder 76, feeding the sheet under a baffle plate 102 in the machine which is spaced above and parallel to the tray cover surface 70. Thus the feeding baffle or chute for the sheet being duplexed is defined by a fixed upper baffle 102 in the machine 10 and a mating opposing lower baffle 100 which is a part of the removable paper tray cassette 70, and removable therewith.

The duplex return feed rollers 90 are positioned, in the duplex printer (or copier) 10 itself, to be upstream of feed rollers 76 and just above cover 100 when the cassette 70 is inserted into its mating insertion aperture in the printer 10, for feeding copy sheets in the duplex path between the fixed baffle arrangement 102 and the top cover member 100 of cassette copy sheet tray to the other end of the cassette 70 without requiring any transporting or driving means in the cassette 70 itself. Not only is that desirable in itself, but also, when the tray 70 is removed, there is no obstruction to removal or retention of a sheet, which is free to drop by gravity and be both readily visible and removable from that entire substantial portion of the duplexing path through the regular cassette loading aperture. This is true here even if the trail edge of the sheet being removed is still in the nip of rollers 90. That is in contrast to normal sheet jam recovery which normally requires operator opening of machine doors and opening of sheet roller nips.

Note that the paper tray cassette 70 is not being used as a duplex tray here. Here, the cassette tray 70 is only a conventional source of clean or blank copy paper for the first side copying operation, and is not a source of sheets during the duplexing or second side copying operation. Here, the sheets being duplexed (the sheets in the duplex path 94), do not stack or go into the tray 70, they slide over the top of the tray 70 and the stack of clean sheets therein.

The cassette feeder 76 for tray 70 is normally disengaged, as shown, with its open or cut-away roller segments overlying and spaced from the stack of sheets in the tray. Thus, the sheets being duplexed can freely pass under the feeder 76 feed rollers and on to the illustrated sheet feeding rollers carrying the sheets to the registration rollers 78. Then the sheet 68 being duplexed can be imaged on its opposite side at transfer station 36, with the appropriate electronically reordered image, in the same way it was imaged on its first side, and fed to the output tray 86 via output path 92 like a simplex copy sheet, this time without reversing the rollers 67. The sheet being duplexed is turned over, only once, in the natural inversion in the paper path provided between tray 70 and transfer station 36.

If desired, the cassette feeder 76 can be operated or utilized to assist in the duplex path feeding by rotating the feed wheels thereof after the sheet being duplexed has been fed under feeder 76 from rollers 90. The feeder 76 will thus treat the sheet being duplexed as if it were forward feeding an already separated top sheet of the stack of sheets in the tray, sliding that sheet over the top of the stack.

As noted, the use of the upper cover surface 100 of a cassette tray as the lower baffle or sheet guide surface for a major portion of the sheet second pass or duplex path provides a signficant advantage, not only in cost and simplicity, but also in jam clearance. Many duplex paths are difficult to clear of paper in the event of a feeding jam. But here, simply by removing the cassette tray 70, as the operator is accustomed to doing anyway for paper loading, that part of the duplex path is fully exposed through the cassette loading entrance, and a jammed sheet therein is removed with the tray. Only one tray 70 is actually needed, but here trays 72 or 74 may be desirably substituted in the top cassette tray location and also provide a duplex path in the same manner, simply by using a standardized cassette upper surface 100 for all cassettes.

To control operation of machine 10, a suitable control panel 87 with various control and print job programming elements is provided. Panel 87 may additionally include a suitable message display windown 88 for displaying various operating information to the machine operator. Conventional or readily programmable software microprocessor controls may be used for all machine and paper path operational controls, as is well known in the art.

It is noted that a simplex-only version of the disclosed printer embodiment has been successfully operating as commercial "Compact Laser Printer" Models 10, 20, 30, and 40, produces of Fugi Xerox Corporation, since about December 1987. The present invention adds full duplex capability thereto with only a few dollars in incremental parts costs. No special or dedicated duplex buffer tray or associated extra sheet feeders or separators therefore are required with the present duplexing system.

Turning now to the exemplary duplexing system disclosed herein, what is disclosed ia a batch mode sequence for duplex printing for a printer with a trayless duplex paper path. As noted, a "page" herein is defined as the image on or for a single side of a single sheet.

In the disclosed printer 10 this duplex buffer loop path length is desirably short, and here is about three copy sheets long. Thus a 3 sheet batch system could be provided, as will be discussed. However, it is preferred to provide a batch duplex system which will be printed at two sheets per batch in order to limit the amount of memory required and reduce the logic complexity. In order to avoid skipped cycles, the sheets are accelerated through the duplex path, at a faster sheet feeding rate, and the system operates asynchronously. The result is that less than half a pitch is skipped for each batch of 4 pages (2 duplexed sheets). Thus if full simplex productivity 13 pages per minute, full duplex productivity will be about 11.5 ppm. The present system can also be utilized for printers which will operate at 3 or more sheets per batch at full duplex productivity using the same basic batch and mode algorithm.

To provie a general or generic definition of the system, the duplex job (the pages in the document set to be copied) is electronically divided or split up, sequentially one batch at a time as it is received, into plural batches of plural pages, with each batch containing pages in continuous ascending serial order. The number of pages in each batch is twice the number of sheets of paper required to fill the duplex paper path. Within each batch, every other (alternate) page is first printed on the first sides of the copy sheets for that batch in ascending order without skipping any pitches between sheets. This is followed by the printing of all of the remaining pages of that batch (eg, the alternate pages not printed on the first sides) onto the second sides of that first batch of copy sheets, printed in ascending order, again without skipping any pitches between sheets. The entire first batch is completed before any pages of the second batch are printed. Then this sequence is repeated for the next batch, and so on, until the job is completed and one collated copy set has been produced. If further copy sets have been requested, the entire process is repeated.

More specifically, in a preferred embodiment where the copy sheets are outputted stacking face down, the job is also divided into batches corresponding to the duplex loop path length and all of the even sides of the first batch are printed, followed by all of the odd sides of that first batch, before any pages of the second batch are printed.

It is preferred that the output tray of the printer system does stack the copy sheets face down. That way a simplex job can also stack face down, so that its simplex pages will be collated after being printed in ascending serial order. Thus, as indicted, for this preferred face down stacking paper path configuration, the first sides printed within each batch for a duplex job will be the even sides, and the second sides printed will be the odd sides. This order results in proper collation of both simplex and duplex jobs in the output tray.

If, for some reason, the paper path configuration is such that simplex prints are stacked face up, then the first sides printed within each batch for a duplex job in the system herein will be the odd sides, and the second sides printed will be the even sides.

As noted, in either case, the duplex set is broken into smaller batches, each of which is completed before printing the next batch, and that batch size is a function of the number of sheets which can be held in the duplex loop. If the trayless path is only long enough to hold only two sheets of paper, an eight page job would be broken into two batches of four pages each. The first batch would preferably be printed on the first two sheets of paper in the page sequence 2, 4, 1, 3. The second batch of four pages would be printed on the second batch of two sheets in the sequence 6, 8, 5, 7. As noted, this sequence provides proper collation of the job output if the sheets are delivered to the output face down. If sheets where delivered face up, then the odd sides in each batch would be printed first.

The dividing into batches of page images and the start of printing can occur while the rest of the job is still being sent to the printer. For example, if the batch divisor is 4, for a 2 sheet buffer loop, as described above, then after only 4 pages have been received the conventional on-board or associated print server electornics will know that the job set is at least 4 pages long, and that the first batch buffer set can thus be divided out and these pages presented to the laser printer in the desired first batch set order, which is pages 2, 4, 1, 3 respectively. In order to further reduce the first copy out time, the printer can start printing after page 2 has been received while pages 3 and 4 of the first batch are still being downloaded from the host. There is no need for the entire batch to be completely downloaded prior to printing appropriate pages from that batch. After all pages from one batch are printed, the printer can then start printing appropriate pages from the next batch as they are received, whether or not the entire batch has been downloaded.

If, alternatively, the trayless duplex path can effectively or efficiently hold three sheets, then the job may be split into batches or sets of six pages each. For a long job, for example, the first set would be 2, 4, 6, 1, 3, 5; the second set would be 8, 10, 12, 7, 9, 11; and the third set would be 14, 16, 18, 13, 15, 17; etc., to the end of the job.

In any case, if desired, printing can actually start as soon as the first even page of any batch is received, since that is the first page to be printed of any buffer set.

For small jobs using a three pitch paper path with the batching method, such as would desirably be found on a smaller printer, the following comparison with the "9700" duplex printer method illustrates the improved productivity using the subject batch method. Jobs where the batching method is advantaged are shown below with their higher effiencies in bolded numbers:

| Pages Per Job | Batch method Sequence | Effi-ciency | "9700" Method Sequence | Effi-ciency |
|---|---|---|---|---|
| 2 | 2,S,S,1 | .50 | 2,S,S,1 | .50 |
| 3 | 2,S,S,1,3 | .60 | 2,S,S,1,3 | .60 |
| 4 | 2,4,S,1,3, | .80 | 2,S,4,1,S,3 | .66 |
| 5 | 2,4,S,1,3,5 | .83 | 2,S,4,1,S,3,5 | .71 |
| 6 | 2,4,6,1,3,5 | 1.00 | 2,S,4,1,6,3,S,5 | .75 |
| 7 | 2,4,6,1,3,5,7 | 1.00 | 2,S,4,1,6,3,S,5,7 | .78 |
| 8 | 2,4,6,1,3,5,8,S,S,7 | .80 | 2,S,4,1,6,3,8,5,S,7 | .80 |
| 9 | 2,4,6,1,3,5,8,S,S,7,9 | .82 | 2,S,4,1,6,3,8,5,S,7,9 | .82 |
| 10 | 2,4,6,1,3,5,8,10,S,7, 9 | .91 | 2,S,4,1,6,3,8,5,10,7, S,9 | .83 |

It can be seen from this table that for 4, 5, 6, 7, and 10 page jobs, the disclosed batching method has superior productivity; and for jobs of 2, 3, 8, and 9 pages in length the productivity is equal.

The same is true even for medium longer jobs, and with longer paper paths. For example, if the "9700" duplex printer had an eight pitch path for the trayless duplex loop, then a comparison of a 20 page job using the two sequences would look like this:

Batch method: 2, 4, 6, 8, 10, 12, 14/1, 3, 5, 7, 9 , 11, 13/16, 18, 20, S, S, S, S, 15, 17, 19 [=83% Eff.]

"9700" method: 2, S, 4, S, 6, S, 8, 1, 10, 3, 12, 5, 14, 7, 16, 9, 18, 11, 20 13, S, 15, S, 17, S, 19 [=77% Eff.]

It may be seen that the disclosed batching sequence never results in more skip cycles than the "9700" duplex printer method, and often results in fewer skip cycles. Thus it is more efficient and productive. The "9700" duplex printer method always requires 6 skipped pitches; 3 for the first series of even sides, and 3 for the last series of odd sides. The batching method, on the other hand, can never skip more that six pitches, but often skips fewer pitches.

To illustrate, consider in the table below a series of jobs of medium length, from 16 to 33 pages per job. To save space, the copying sequences for these jobs are not written out, but the respective numbers of skipped pitches and the respective efficiencies are shown in this table:

| Pages per job | Batch Mode Skips | Eff. | 9700 Mode Skips | Eff. |
|---|---|---|---|---|
| 16 | 6 | .72 | 6 | .72 |
| 17 | 6 | .74 | 6 | .74 |
| 18 | 5 | .78 | 6 | .75 |
| 19 | 5 | .79 | 6 | .76 |
| 20 | 4 | .83 | 6 | .77 |
| 21 | 4 | .84 | 6 | .78 |
| 22 | 3 | .88 | 6 | .79 |
| 23 | 3 | .88 | 6 | .80 |
| 24 | 2 | .92 | 6 | .81 |
| 25 | 2 | .93 | 6 | .81 |
| 26 | 1 | .96 | 6 | .82 |
| 27 | 1 | .96 | 6 | .82 |
| 28 | 0 | 1.00 | 6 | .82 |
| 29 | 0 | 1.00 | 6 | .83 |
| 30 | 6 | .83 | 6 | .83 |
| 31 | 6 | .84 | 6 | .84 |
| 32 | 5 | .86 | 6 | .84 |
| 33 | 5 | .87 | 6 | .85 |
| AVG.: | 3.5 | .87 | 6 | .80 |

It can be seen from the above table that for medium length jobs, the batch method results in substantially improved productivity. As the job lengths grow longer, the productivity advantage of the batch sequencing method diminishes.

In summary, what is disclosed is an improved copying sequence for duplex printing for a printer with a trayless duplex paper path. The job is divided into small batches, filling and unfilling the duplex path loop, and all of the first sides of the first batch are printed, followed by printing all of the second sides of that first batch (returned by the duplex path loop), before any pages of the second batch are printed. The principal advantage is increased overall productivity, regardless of variations in the average job size, or the paper path length. When used on a small printer with a short trayless duplex path, this sequence offers improved first copy out time when compared to sequences which require a duplex tray and use the stack and re-feed method of duplex printing. This method also limits the number of pages which must be stored in memory in order to insure full job recovery in the event of a paper jam.

While the embodiment disclosed herein is preferred, it will be appreciated from this teaching that various alternatives, modifications, variations or improvements therein may be made by those skilled in the art, which are intended to be encompassed by the following claims:

I claim:

1. In a printer for printing and outputting collated sets of plural duplex copy sheets from a multipage job set of multiple electronically reorderable page images, wherein said collated outputted duplex copy sheets have one said page image printed on one side of a copy sheet and another said page image printed on the other side of the copy sheet, and wherein said printer includes a duplexing buffer loop providing a plural copy sheet capacity duplexing path for recirculating therein plural copy sheets imaged on one side back to be imaged on their opposite sides to make said duplex copies, the improvement comprising;

electronically dividing the multipage job set into plural batches of plural page images per batch with the number of page images per batch corresponding to said copy sheet capacity of said duplexing path, within a said batch, reordering said plural page images within said batch for proper collated duplex printing with said duplexing buffer loop, printing copy sheets from one said batch of page images at a time, by printing the first sides of a corresponding batch of copy sheets with alternate pages of said one batch and recirculating said copy sheets is in said duplexing path, and then printing the remaining page images of said one batch (the alternate page images not printed on said first sides of said copy sheets) onto the second sides of said batch of copy sheets, prior to printing page images from any other said batch of page images, and consecutively repeating this process for subsequent said batches until a collated copy set is produced from the multipage job set.

2. The printer of claim 1, wherein consecutive said batches consecutively contain page images in ascending serial page order, and said batches are consecutively printed in ascending serial order.

3. The printer of claim 1, wherein said multi-page job set comprises the pages of a multipage document to be copied which are sent electroncially to the printer in ascending serial page order, and which are electronically divided into said pluarl batches sequentially, one batch at a time, as the page images are being received, in the order of receipt, with consecutive said batches respectively containing page images in ascending serial page order, and wherein said batches are consecutively printed in the sequential order in which they are divided.

4. The printer of claim 1, wherein said plural copy sheet capacity duplexing path is a trayless duplexing path with an endless loop plural sheet path length, and wherein said number of page images in each said batch is approximately twice the number of copy sheets required to fill said copy sheet path length of said trayless duplexing path.

5. The printer of claim 1, wherein said plural copy sheet capacity duplexing path is a trayless duplexing path with a copy sheet path length of two or three copy sheets, and wherein the multi-page job set is divided into batches of four page images per batch, and wherein the first batch to be printed is printed on the first two copy sheets to be printed with the page image sequence 2, 4, 1, 3; and wherein the second batch to be printed is printed on the next two copy sheets with the page image sequence 6, 8, 5, 7.

6. The printer of claim 5, wherein the trayless duplexing path copy sheet length is three, and wherein the multi-page job set is divided into batches of six page images per batch so that the first batch to be printed is printed on the first three copy sheets to be printed with the page image sequence 2, 4, 6, 1, 3, 5.

7. The printer of claim 1, wherein said copy sheets are outputted to stack face down, and wherein all of the even side page images of one said batch are printed first, followed by printing all of the odd side page images of that batch, before any page images of another batch are printed.

8. The printer of claim 1, wherein, for other than a very small job set, and for all but the last batch of plural page images in certain job sets, for every said batch every other (alternate) page image of that one batch is first printed on the first sides of a corresponding batch of copy sheets in ascending page image order without skipping any copying pitches between copy sheets, and said one batch of copy sheets is recirculated in said duplexing path, and wherein this is followed by the printing of all of the remaining page images of that same batch (the alternate page images not printed on said first sides of said copy sheets) onto the second sides of said first batch of copy sheets, printed in ascending order without skipping any copying pitches between copy sheets, and prior to printing any page images from any other said batch.

9. The printer of claim 1, wherein said multi-page job set comprises the pages of a multipage document to be copied which are sent electronically to the printer in ascending serial page order, and which are electronically divided into said plural batches sequentially, one batch at a time, as the page images are being received, batched in the order of receipt, with consecutive said batches respectively containing page images in ascending serial page order, and wherein said batches are consecutively printed in the sequential order in which they are received and divided, but wherein within each said batch the page images therein are reordered in a nonseqential page order for proper duplex printing in ascending serial outputted copy sheet page order for that said duplexing buffer loop.

10. The printer of claim 8, wherein each said batch contains a small number of page images which are internally reordered within the batch to be duplex printed in ascending serial outputted copy sheet page order, this small number of page images within a batch being approximately twice the number of copy sheets required to fill said copy sheet capacity of said duplexing path, and wherein said muti-page job set comprises the pages of a mutipage document to be copied which are sent electronically to the printer in ascending serial page order, and which are electronically divided into said plural batches sequentially, one batch at a time, as the page images are being received, batched in the order of receipt, with consecutive said batches respectively containing page images in ascending serial page order, and wherein said batches are consecutively printed in the sequential order in which they are received and divided, and wherein all the copy sheets are outputted stacking face down, and wherein all of the even side pages images of each batch are printed first, followed by printing all of the odd side page images of that batch, before any page images of any other batch are printed.

* * * * *